US007706559B2

(12) United States Patent
Collins

(10) Patent No.: US 7,706,559 B2
(45) Date of Patent: Apr. 27, 2010

(54) APPARATUS FOR SUPPRESSING RADIO FREQUENCY INTERFERENCE IN A MICROPHONE ASSEMBLY WITH PREAMPLIFIER

(75) Inventor: James S. Collins, Elk Grove Village, IL (US)

(73) Assignee: Knowles Electronics, LLC, Itasca, IL (US)

( * ) Notice: Subject to any disclaimer, the term of this patent is extended or adjusted under 35 U.S.C. 154(b) by 1328 days.

(21) Appl. No.: 11/176,455

(22) Filed: Jul. 7, 2005

(65) Prior Publication Data

US 2006/0008105 A1 Jan. 12, 2006

Related U.S. Application Data

(60) Provisional application No. 60/586,759, filed on Jul. 9, 2004.

(51) Int. Cl.
*H04R 25/00* (2006.01)

(52) U.S. Cl. ..... 381/361; 381/174

(58) Field of Classification Search ..... 381/355, 381/361, 174, 369
See application file for complete search history.

(56) References Cited

U.S. PATENT DOCUMENTS 3,698,080 A * 10/1972 Berner ..... 438/109
3,944,756 A * 3/1976 Lininger ..... 381/355
5,408,534 A * 4/1995 Lenzini et al. ..... 381/191
6,084,972 A * 7/2000 Van Halteren et al. ..... 381/92
6,151,399 A * 11/2000 Killion et al. ..... 381/313
7,239,714 B2 * 7/2007 de Blok et al. ..... 381/369
7,352,876 B2 * 4/2008 Boor et al. ..... 381/174

FOREIGN PATENT DOCUMENTS

DE 34 25 175 A1 3/1986
EP 0 800 331 A2 10/1997
WO WO-95/22879 A2 8/1995

OTHER PUBLICATIONS

International Search Report for Application No. PCT/US05/024481 dated Oct. 28, 2005.

* cited by examiner

*Primary Examiner*—Fan Tsang
*Assistant Examiner*—Phylesha Dabney
(74) *Attorney, Agent, or Firm*—Fitch, Even, Tabin & Flannery

(57) ABSTRACT

A microphone assembly comprises a housing that includes a conductive material. A preamplifier circuit is disposed within the housing, the preamplifier circuit having a signal input and a ground terminal. A microphone portion is disposed within the housing, the microphone portion having an output coupled to the signal input of the preamplifier circuit. A ribbon wire is attached to the ground terminal of the preamplifier circuit and is attached to the housing.

14 Claims, 12 Drawing Sheets

APPARATUS FOR SUPPRESSING RADIO FREQUENCY INTERFERENCE IN A MICROPHONE ASSEMBLY WITH PREAMPLIFIER

CROSS-REFERENCE TO RELATED PATENT APPLICATIONS

This patent claims the benefit of U.S. Provisional Application No. 60/586,759, filed Jul. 9, 2004, the disclosure of which is hereby incorporated herein by reference in its entirety for all purposes.

TECHNICAL FIELD

This patent generally relates to microphones used in listening devices, such as hearing aids or the like, and more particularly, to a microphone assembly with preamplifier in which a ribbon wire is contained.

BACKGROUND

Hearing aid technology has progressed rapidly in recent years. Technology advancements in this field continue to improve the reception, wearing-comfort, life-span, and power efficiency of hearing aids. With these continual advances in performance of ear-worn acoustic devices, ever-increasing demands are placed upon improving the inherent performance of the miniature acoustic transducers that are utilized. There are several different hearing aid styles known in hearing aid industry: Behind-The-Ear (BTE), In-The-Ear or All-In-The-Ear (ITE), In-The-Canal (ITC), and Completely-In-The-Canal (CIC).

Generally, a listening device, such as a hearing aid, includes a microphone portion, an amplification portion, and a receiver portion. The microphone portion receives vibration energy, i.e. acoustic sound waves in audible frequencies, and generates an electronic signal representative of these sound waves. The amplification portion accepts the electronic signal, increases the electronic signal magnitude, and communicates the increased electronic signal (e.g. the processed signal) to the receiver portion. The receiver portion, in turn, converts the increased electronic signal into vibration energy for transmission to a user.

The electronic signal communicated from the microphone portion to the amplification portion, is susceptible to high frequency interference radiated, for example, in the range of 1-3 GHz. To reduce the sensitivity to low and high radio frequency interference (RFI), the conventional microphone assembly comprises a preamplifier assembly with capacitive coupling. In particular, the microphone portion can be communicatively coupled to the preamplifier assembly to reduce the RFI generated by communication devices such as cellular phones, web-enabled phones, personal digital assistants (PDAs), laptops, other devices that may be capable of communication over one or more public or private communication networks. Further, microphone assemblies include an external and an internal ground wirings or electrical paths to connect the portions of the microphone casing and further reduce the sensitivity to low and high RFI signals. However, known microphone assemblies provide poor RFI suppression in the presence of a communication device such as cellular phone and thereby making the microphone assembly less attractive to potential customers. In addition, known microphone assemblies that provide acceptable RFI suppression often require additional, and costly, assembly steps to connect and position ground wires between the individual external portions of the microphone casing.

BRIEF DESCRIPTION OF THE DRAWINGS

For a more complete understanding of the disclosure, reference should be made to the following detailed description and accompanying drawings wherein.

Figure 1:
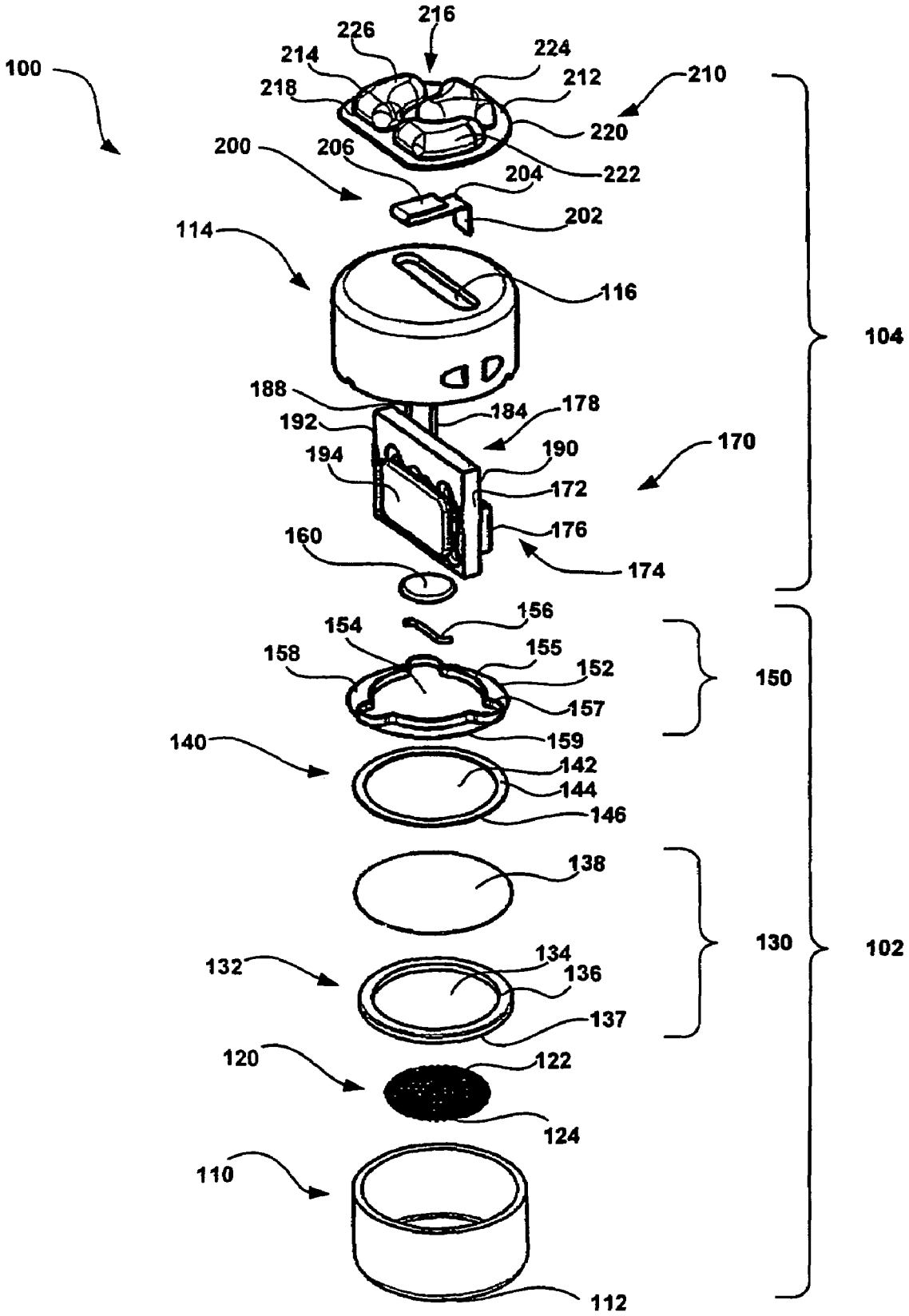
FIG. 1 is an exploded view illustrating a microphone assembly embodying the teachings of the present invention.

The drawings are for illustrative purposes only and are not intended to be to scale.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

It should also be understood that, unless a term is expressly defined in this patent using the sentence "As used herein, the term '_' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

FIG. 1 illustrates an exploded view of a microphone assembly 100 that can be used in virtually any type of hearing aids, such as BTE, ITE, ITC, CIC, or the like. The microphone assembly 100 includes an electret microphone portion 102 and a back volume portion 104. The microphone portion 102 may include a bottom housing 110, a damping element or filter 120, a diaphragm assembly 130, a spacer 140, and a backplate assembly 150. The cylindrical bottom housing 110 may be manufactured from a variety of materials such as, for example, stainless steel, alternating layers of conductive materials, alternating layers of non-conductive materials (e.g., metal particle-coated plastics), etc. However, it will be understood that any housing shape or configuration suitable for a particular application may be suffice, including a roughly square shape (see FIGS. 8-11), a rectangular shape or any other desired geometry. At least one aperture or acoustic port 112 (see FIG. 3) is formed on the bottom surface of the housing 110 to allow acoustic waves or sonic energy to enter the microphone assembly 100. For certain applications, an optional snout (not shown) with a sound passage may be attached to the bottom housing 110 to guide the acoustical signal from the outside environment into the microphone assembly 100 via the acoustic port 112.

The damping element 120 will typically be shaped to correspond to the internal configuration of the housing 110, but may be shaped in: various ways and adapted to compliment the internal configuration of a particular implementation of a housing. In the illustrated embodiment, the damping element 120 has a circular shape corresponding to a shape of the housing 110. The damping element 120 provides an acoustical resistance to the microphone assembly 100 and may be made of nickel (Ni) having a first surface 122 and a second surface 124. The damping element 120 further prevents debris from entering the microphone assembly 100, which may damage the working components contained within the microphone assembly 100.

The diaphragm assembly 130 includes a diaphragm support 132 and a diaphragm 138 fixedly attached thereto. The diaphragm support 132 in the form of an annular ring shape and corresponding to the internal configuration of the housing 110 may typically be manufactured of any electrically conductive material such as stainless steel; however, any material that includes an electrically conductive coating may also be utilized. The diaphragm support 132 includes a through hole 134, a first surface 136, and a second surface 137. The diaphragm 138 in the form of a circular shape is an electrically conductive material or a thin polymer film, commonly under the trade name MYLAR and under other trade names, peripherally attached to the first surface 136 of the diaphragm support 132, for example, by bonding with adhesive. However, it will be understood by those of ordinary skills in the art that any form of joining would suffice, including compression, or mechanical attachment at the edges, and the like.

The backplate assembly 150 may include an integral connecting wire 156 that electrically couples the microphone portion 102 to the back volume portion 104. The illustrated backplate assembly 150 further includes a backplate support 152 and a backplate 154 fixedly attached thereto. The backplate 154 in the form of a disc shape having at least one relief section 155 and at least one protrusion 157 is made of an electrically conducting material such as a stainless steel. The backplate support 152 in the form of an annular ring shape and correspond to the internal configuration of the housing 110 may typically be manufactured of any electrically conductive material such as stainless steel; however, any material that includes an electrically conductive coating may also be utilized. The backplate support 152 includes a through hole partially covered by the backplate 154, a first surface 158, and a second surface 159. The bottom surface of the backplate 154 plated with a polarized dielectric film or electret material, commonly available under the trade name TEFLON, capable of maintaining an electrostatic charge is mounted by adhesive fillets (not shown) to the first surface 158 of the backplate support 152.

The spacer 140 having a thickness spaced between the diaphragm assembly 130 and the backplate assembly 150 for electrically isolating the diaphragm assembly 130 from other components within the microphone assembly 100 and may include a hollow section 142, a first surface 144, and a second surface 146. The spacer 140 in the form of an annular ring shape corresponding to the housing 110 is made of an electrically insulating material such as a 200 gauge Mylar plastic having a thickness and separates the diaphragm assembly 130 from the backplate assembly 150. The first surface 144 of the spacer 140 is held in contact with the backplate assembly 150 and the second surface 146 of the spacer 140 is held in contact with the diaphragm assembly 130.

The back volume portion 104 includes a preamplifier assembly 170, a top housing 114, a ribbon wire 200, and a flex circuit assembly 210. The preamplifier assembly 170 may comprise a hybrid circuit 172 including an impedance buffer circuit 174 such as, for example, a source-follower field effect transistor (FET) integrated circuit 176 adapted to reduce RFI, for example RFI generated by communication devices. The preamplifier assembly 170 may further include a plurality of electrical connection terminals 178 (see FIG. 2), a first wire 184, and a second wire 188. First and second resistance-capacitance networks (not shown) are connected to the terminals 178. The hybrid circuit 172, attached to the microphone portion 102 adjacent to the backplate assembly 150, is positioned within the top housing 114 and includes a first surface 190 and a second surface 192. The terminals 178, the FET 176, the first resistance-capacitance network, and the second resistance-capacitance network are operably mounted to the first surface 190 of the hybrid circuit 172. A filter capacitor 194 is operably mounted to the second surface 192 of the hybrid circuit 172. A conductive element 160, such as a silver filled epoxy, attaches to the edge of the hybrid circuit 172 thereby connecting to the microphone portion 102 via the integral connecting wire 156. Thus, the backplate assembly 150 and the diaphragm assembly 130 are communicatively coupled to the preamplifier assembly 170 to transmit and provide acoustic signals thereto via the connection between the conductive element 160 and the integral connecting wire 156.

The cylindrical top housing 114 is made of stainless steel, however, it will be understood that any housing shape or configuration complimentary to the bottom housing 110 and suitable for the particular application would suffice. An opening 116 positioned on the upper surface of the top housing 114 provides a connection between the preamplifier assembly 170 and the flex circuit assembly 210, which will be described in greater detail. The opening 116 may be formed in any suitable manner such as drilling, punching, or molding. The exemplary ribbon wire 200 includes a first region 202, a second region 204, and a third region 206. The ribbon wire 200 may be formed from a blank, and may comprise a gold plated nickel wire having low inductance and low radio frequency (RF) resistance, for example. The nickel wire may be plated with other materials such as copper or silver, for example. Additionally, other low inductance and low radio frequency (RF) resistance materials may be used. The ribbon wire 200 can be fabricated and formed using conventional wire fabrication and forming techniques that are well known in the art. As illustrated in FIG. 1, the first, second, and third regions 202, 204, 206, respectively, are bent such that the third region 206 is substantially parallel to the second region 204 and the first region 202 is substantially perpendicular to the second and third regions 204, 206. The first region 202 is electrically connected to the terminal 178 and extends through the opening 116. The second region 204 may be attached to the housing 114 (e.g., by solder, conductive adhesive, welding, etc.) adjacent to the opening 116. It is believed that the ribbon wire 200 provides less inductive reactance at cell phone frequencies as compared to grounding wires used previously. Additionally, the connection of the ribbon wire 200 proximate to the hole 116 through which the wires 184 and 188 extend creates a short grounding path, and it is believed that this also helps reduce the inductive reactance. The reduced inductive reactance helps reduce undesirable RFI generated by any communication devices. The third region 206 is electrically connected to the flex circuit assembly 210.

Figure 3:
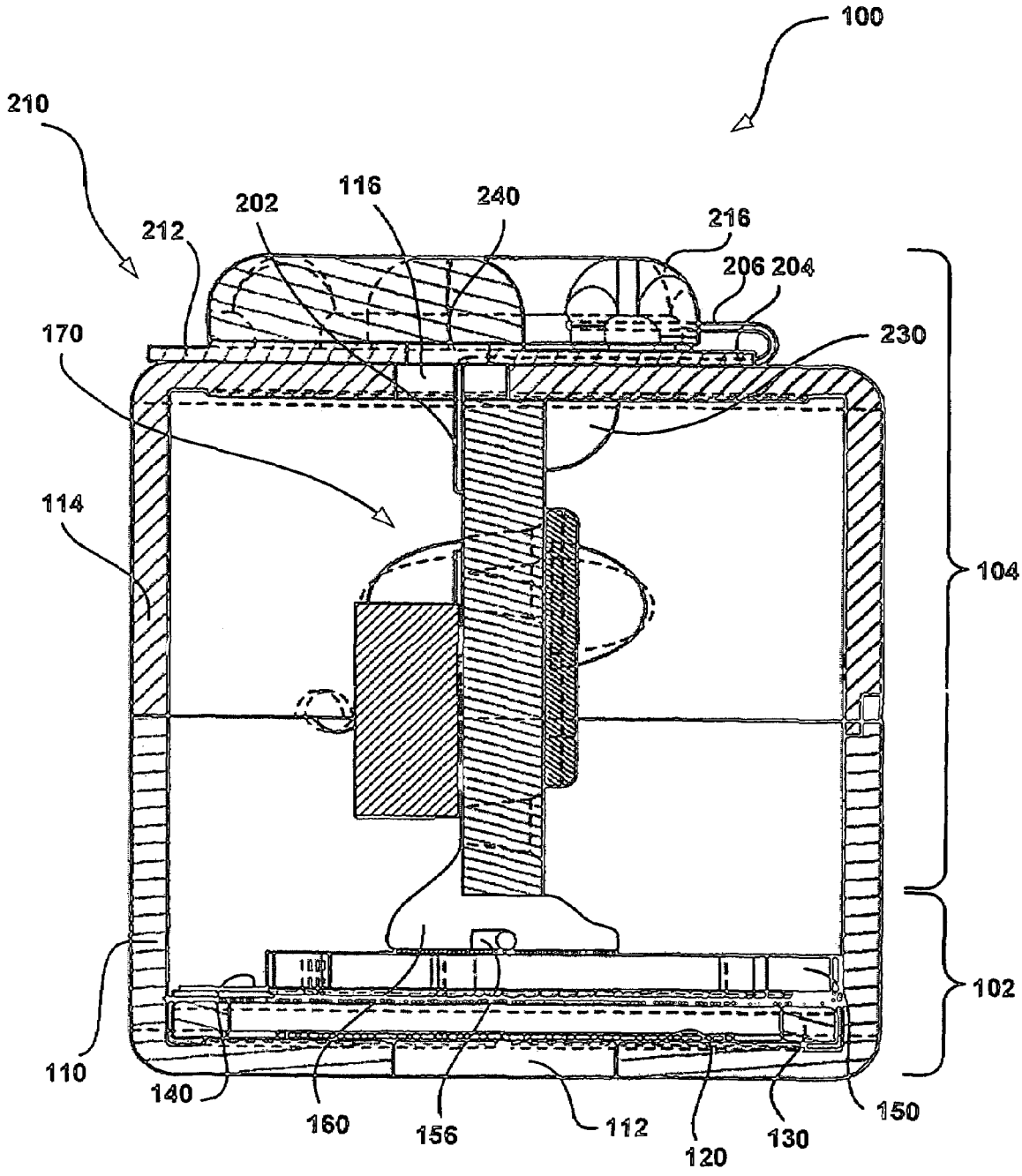
FIG. 3 is a cross-sectional view of the microphone assembly of FIG. 1.

The flex circuit assembly 210 of FIG. 1 includes a flex circuit 212, a plurality of connecting terminals 214 operably connected to the flex circuit 212, and a plurality of soldering pads 216 mounted on the connecting terminals 214. The flex circuit 212 comprises a first surface 218 and a second surface 220 shaped to compliment the top housing 114. The flex circuit 212 may be made of glass filled epoxy and mounted on the top surface of the housing 114 by fixedly attaching the second surface 220 of the flex circuit 212 thereto. However, it will be understood that any flex circuit shape or configuration suitable for a particular application may suffice. As shown in FIG. 1, the flex circuit 212 is a circular shape with a cut-out on one end to allow the ribbon wire 200 to extend around the flex circuit 212 as shown in FIG. 3. The plurality of connecting terminals 214 comprises a ground terminal 222, an output terminal 224, and an input terminal 226. The plurality of soldering pads 216 are electrically connected to the terminals 214 to provide electrical connection to the components within the hearing aid (not shown).

Figure 2:
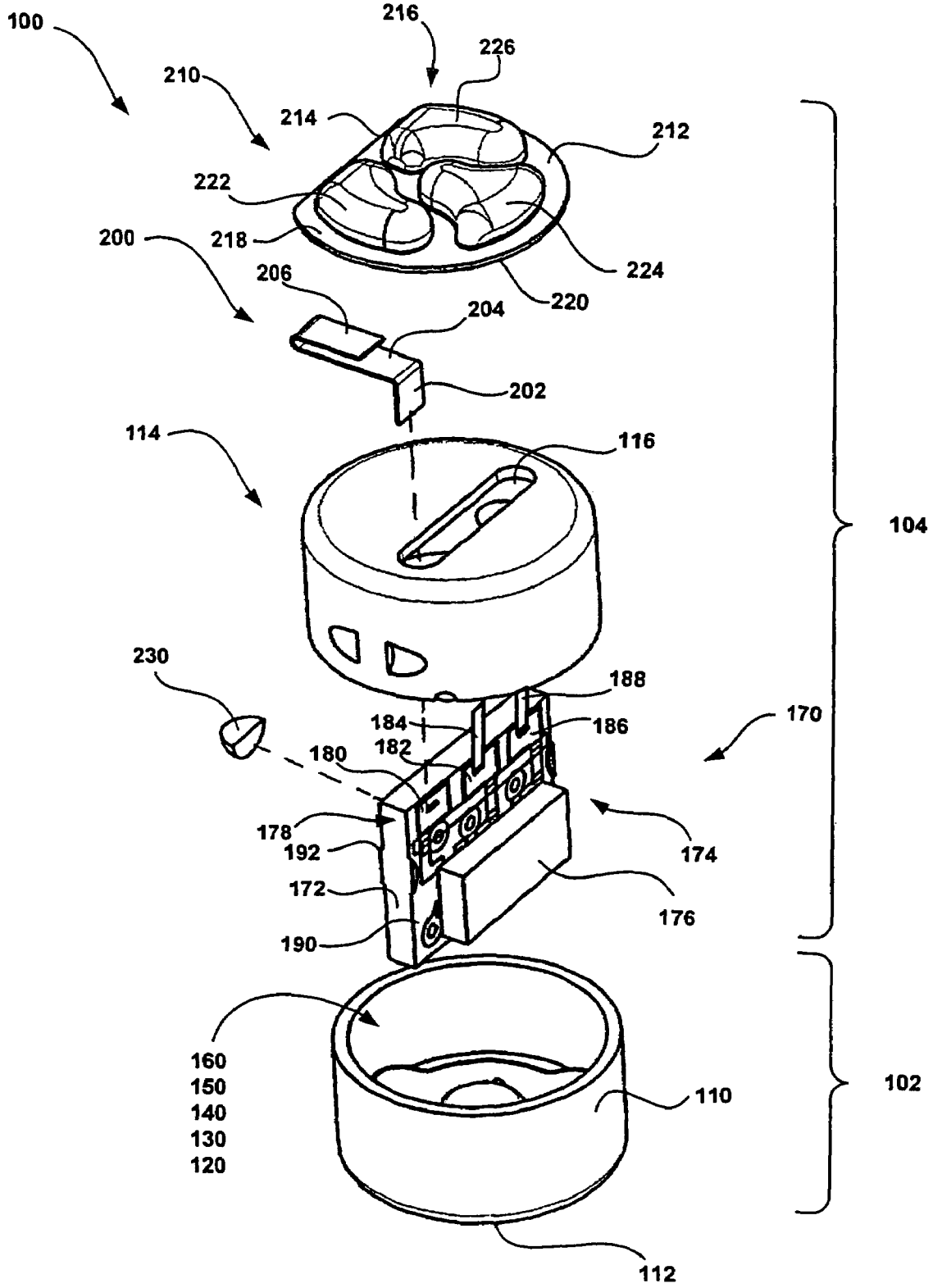
FIG. 2 is an enlarged exploded view of the microphone assembly shown in FIG. 1.

FIG. 2 illustrates an enlarged partially exploded view of the exemplary cylindrical microphone assembly 100 of FIG. 1. In mounted condition, the damping element 120 is secured to the inner surface of the housing 110. The backplate assembly 150, the spacer 140, and the diaphragm assembly 130 are disposed within the housing 110 collectively constitute the electret microphone portion 102. It will be understood that the operation of the microphone assembly 100 is generally based on the generation of an electrical signal by the fixed electrode of the backplate assembly 150 representative of the diaphragm assembly 130 movement in response to exposure to acoustic waves or sonic energy.

The terminal 178 of the preamplifier assembly 170 may include a ground connection (GND) 180, an output connection ($V_{OUT}$) 182, and an input connection ($V_{IN}$) 186. The GND 180 of the preamplifier assembly 170 connects to the ground terminal 222 of the flex circuit assembly 210 via the ribbon wire 200 to reduce the sensitivity to low and high RFI signals generated, for example, by communication devices, such as cellular phones. The $V_{OUT}$ 182 of the preamplifier assembly 170 supplies an amplifier output signal and is connected with the output terminal 224 of the flex circuit assembly 210 via the first wire 184. The $V_{IN}$ 186 of the preamplifier assembly 170 supplies electric power to the buffer circuit 174 and is connected with the input terminal 226 of the flex circuit assembly 210 via the second wire 188. A conductive bonding material 230 such as a conductive adhesive (e.g., an epoxy with suspended metallic flakes) or a solder material may be mounted on the second surface 192 of the hybrid circuit 172. The conductive bonding material 230, in turn, attaches or seals to the inner top surface of the housing 114 to further suppress undesirable RFI signals generated, for example, by any communication devices. Examples of conductive bonding material 230 include a two-part silver epoxy adhesive, or a solder, that provides high electrical conductivity and strong conductive bonding. Conductive adhesive can replace traditional tin-lead (Sn—Pd) solder and can further act as an effective heat sink.

FIG. 3 illustrates a cross-sectional view of the exemplary microphone assembly 100. As discussed earlier, the damping element 120 is positioned within the housing 110 and adjacent to the acoustic port 112, through which received acoustic waves may enter the housing 110. The backplate assembly 150, the spacer 140, and the diaphragm assembly 130 collectively constitute the electret microphone portion 102 and are disposed within the housing 110. A plane defined by the alignment of the preamplifier assembly 170 is substantially normal to the top surface of the housing 114. In mounted condition, the conductive adhesive 230 is applied to the second surface 192 of the preamplifier assembly 170. The conductive bonding material 230 is attached and sealed to the inner top surface of the housing 114 to help suppress RFI signals. The first region 202 of the ribbon wire 200 is electrically connected to GND 180 of the preamplifier assembly 170 and the preamplifier assembly 170 is mounted on the backplate assembly 150 via the conductive element 160 such that the electret microphone portion 102 is communicatively coupled to the preamplifier assembly 170 via the integral connecting wire 156 to transmit and provide acoustic signals thereto. When all the working components are placed in final or closed position within the housings 110, 114, the top housing 114 is then mounted to the bottom housing 110 locking the working components in position.

A portion of the ribbon wire 200 and the first and second wires (see FIGS. 1-2) extend through the opening 116 of the housing 114 to provide a connection between the preamplifier assembly 170 and the flex circuit assembly 210. As shown in FIG. 3, the second region 204 of the ribbon wire 200 is substantially parallel to the top surface of the housing 114 and may be attached to the housing 114 (e.g., by a conductive bonding material or welding) to reduce inductive reactance. The third region 206 of the ribbon wire 200 is substantially parallel to the second region 204 and is electrically connected to the ground terminal 222 of the flex circuit assembly 210. The flex circuit assembly 210 is mounted to the top surface of the housing 114 and a plurality of soldering pads 216 is mounted to the flex circuit assembly 210 for providing an electrical connection to the components within the hearing aid (not shown).

Figure 4:
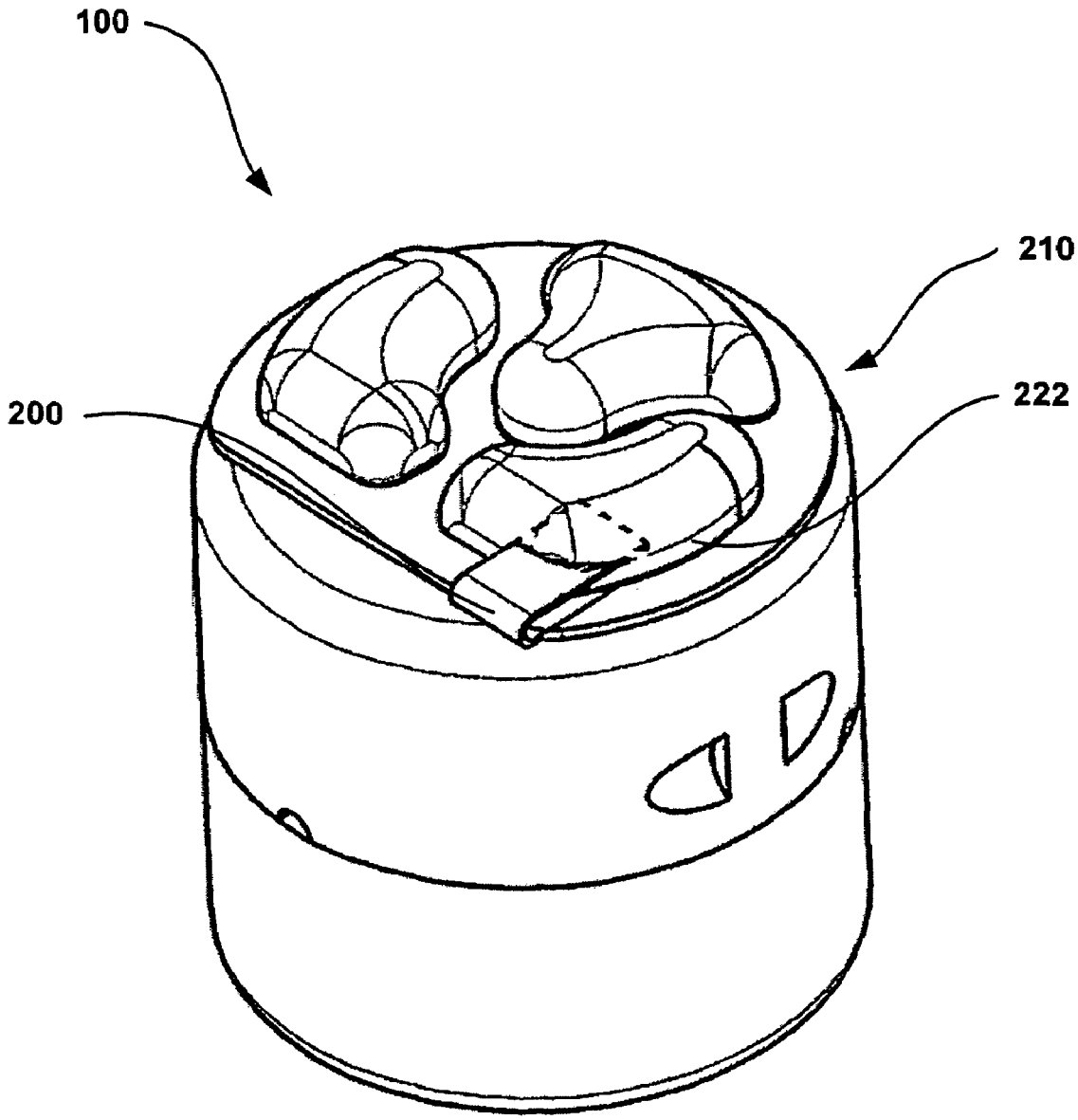
FIG. 4 is a perspective view of the microphone assembly of FIG. 1.

FIG. 4 illustrates a perspective view of the microphone assembly 100 embodying the teachings of the present invention. The flex circuit assembly 210 with a cut out on one end is fixedly attached to the top surface of the housing 114 and the ribbon wire 200 extends around the flex circuit 212 to connect to the ground terminal 222.

Figure 5:
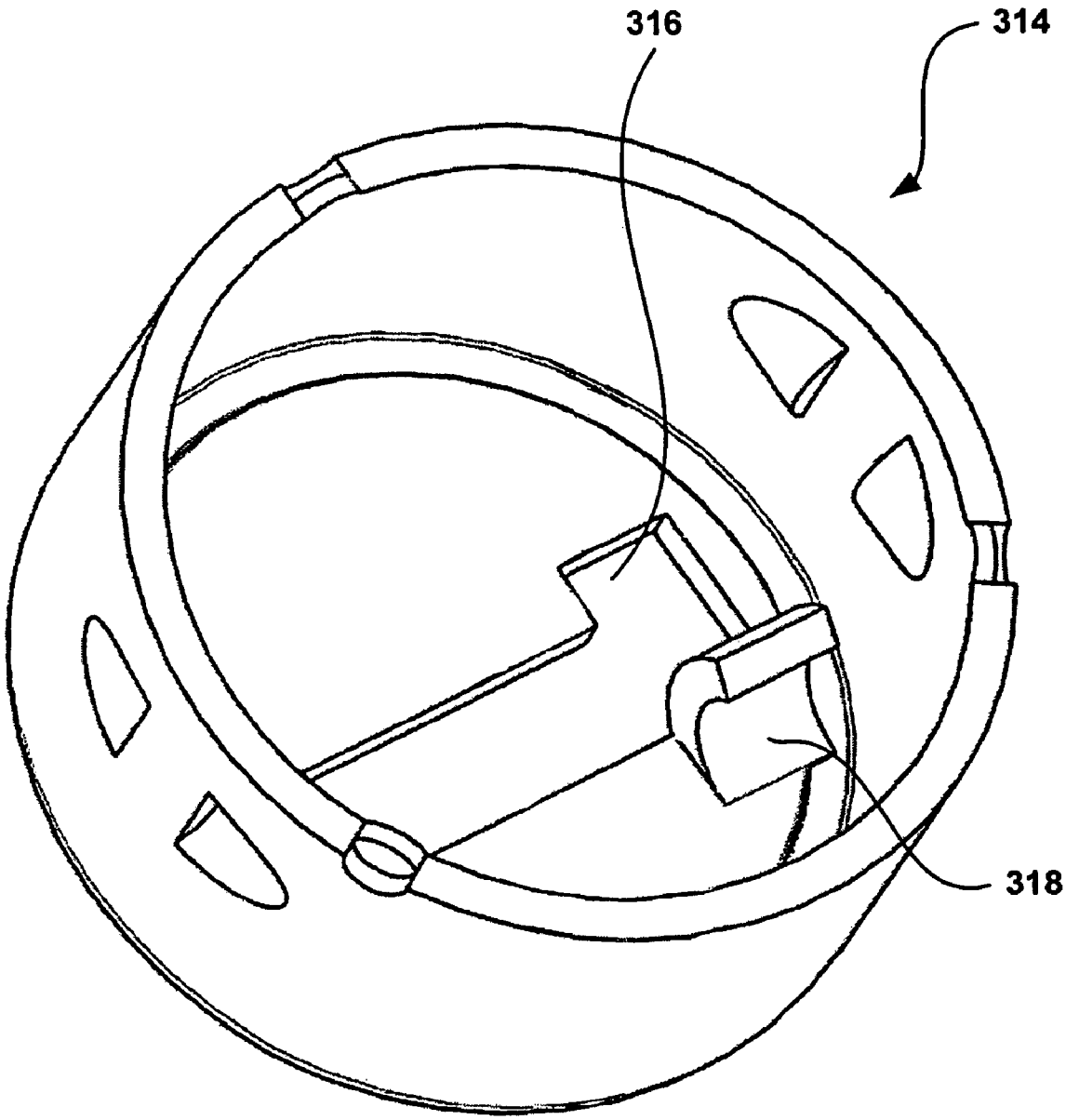
FIG. 5 is a perspective view of a portion of a microphone housing of a second embodiment of the present invention.
Figure 6:
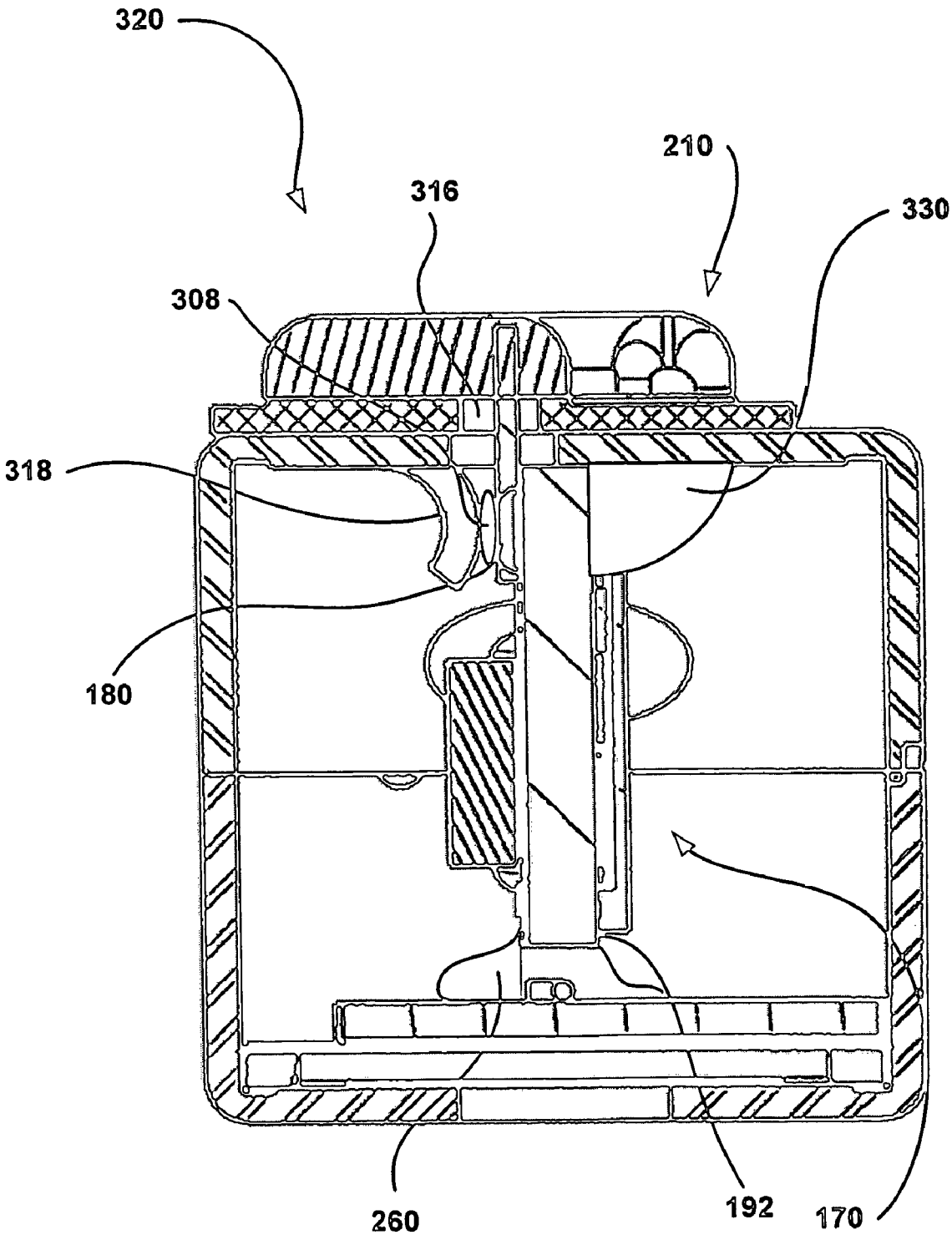
FIG. 6 is a cross-sectional view of the second embodiment of the microphone assembly.

A second embodiment directed to an electrically connecting member intervening between the preamplifier assembly and the housing is shown in FIGS. 5 and 6. The second embodiment is similar to the embodiment illustrated in FIGS. 1-4.

In FIG. 5, a top housing 300 comprises a T-shape opening 316. A tab 318 bends inward to provide a connection with the preamplifier assembly 170 (see FIG. 6). The tab 318 may be formed from a cut out corresponding to a portion of the opening 316 where one end of the tab 318 remains attached to the opening 316. The tab 318 and the housing 314 may be made of stainless steel, however, it will be understood that any variety of materials such as alternating layers of conductive materials, and alternating layers of non-conductive materials (e.g. metal particle-coated plastics) would suffice.

FIG. 6 illustrates a cross-sectional view of the second embodiment of the microphone assembly 100 according to the present invention. A first conductive bonding material 330 is applied to the second surface 192 of the preamplifier assembly 170 and the inner surface of the housing 314 adjacent the second surface 192 of the preamplifier assembly 170 to suppress undesirable RFI signals. The tab 318 is attached to the GND 180 of the preamplifier assembly 170 using a second conductive bonding material 308 such as epoxy with suspended metallic flakes, solder, etc. Alternatively, a layer of gold electro-plating (not shown) is applied to the surface of the tab 318 to assist better solder to the GND 180 for lower RF resistance. Other materials may be applied to the surface of the tab as well such as copper or silver. The connection of the GND 180 to the housing 314 proximate to a hole 316 through which wires between the preamplifier assembly 170 and the flex circuit assembly 210 creates a short grounding path, and it is believed that this helps reduce the inductive reactance. Additionally, the connection of the preamplifier assembly 170 to the housing 314 using the conductive bonding material 330 proximate to the hole 316 also helps create a short grounding path, and it is believed that this also helps reduce the inductive reactance. The reduced inductive reactance helps reduce undesirable RFI generated by any communication devices.

Figure 7:
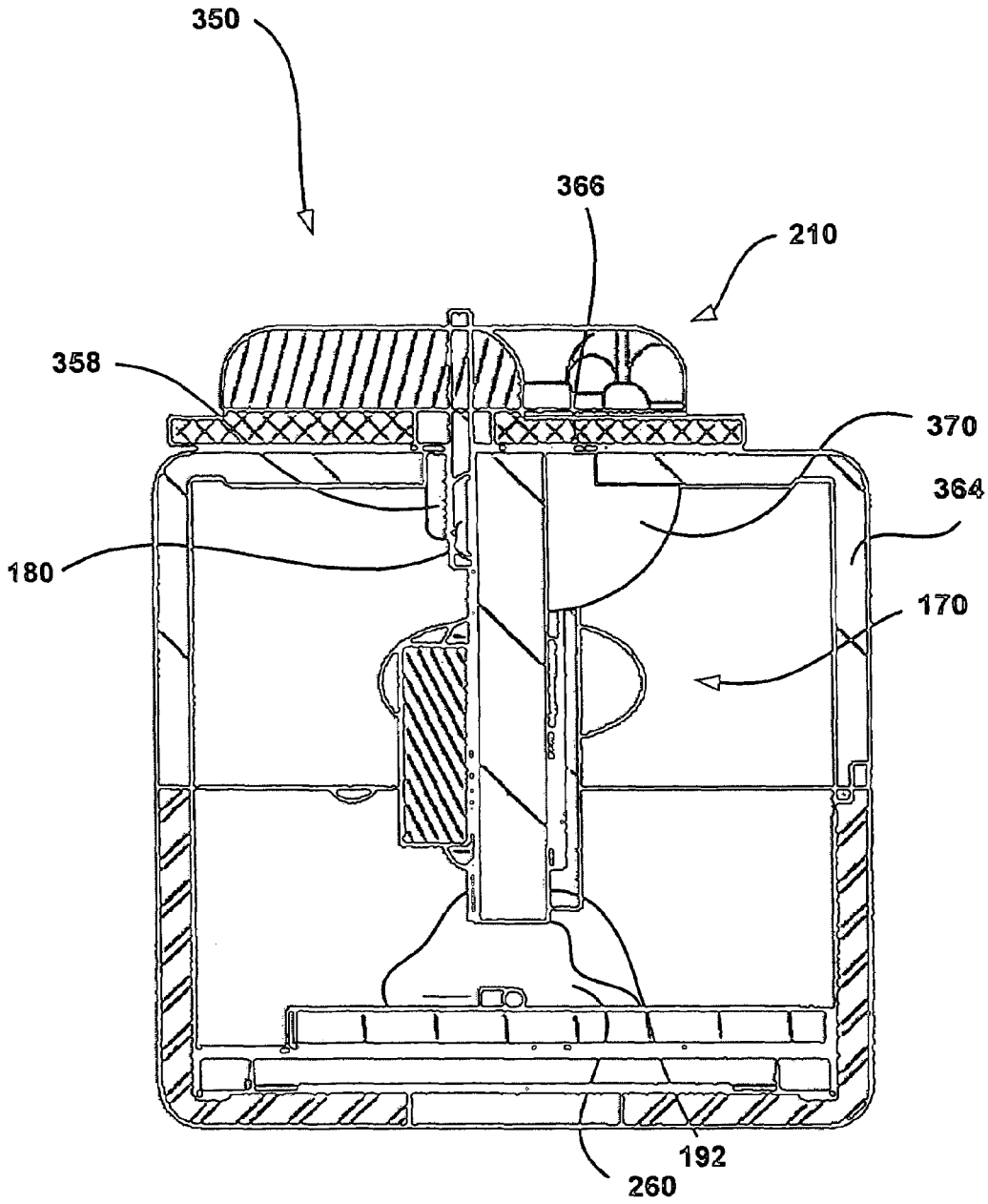
FIG. 7 is a cross-sectional view of a third embodiment of a microphone assembly of the present invention.

A third embodiment directed to an electrically connecting member intervening between the preamplifier assembly and the housing is shown in FIG. 7. The embodiment 350 is similar to the embodiment illustrated in FIGS. 1-4.

In the third embodiment of the microphone assembly 350 according to the present invention, an opening 366 of a housing 364 is wider than the opening 116 of the housing 114 as shown in FIGS. 1-3 for receiving the preamplifier assembly 170. A first conductive bonding material 370 is applied to the second surface 192 of the preamplifier assembly 170 and the inner surface of the housing 364 adjacent the second surface 192 of the preamplifier assembly 170 to seal one end of the opening 216 and suppress RFI signals. A second conductive bonding material 358 such as epoxy with suspended metallic flakes or solder is applied between the GND 180 of the preamplifier assembly 170 and one end of the opening 366 to seal and provide an electrical path to ground and help reduce undesirable RFI caused by any communication devices. The flex circuit assembly 210 is fixedly attached to the housing 114 and the preamplifier assembly 170.

Figure 8:
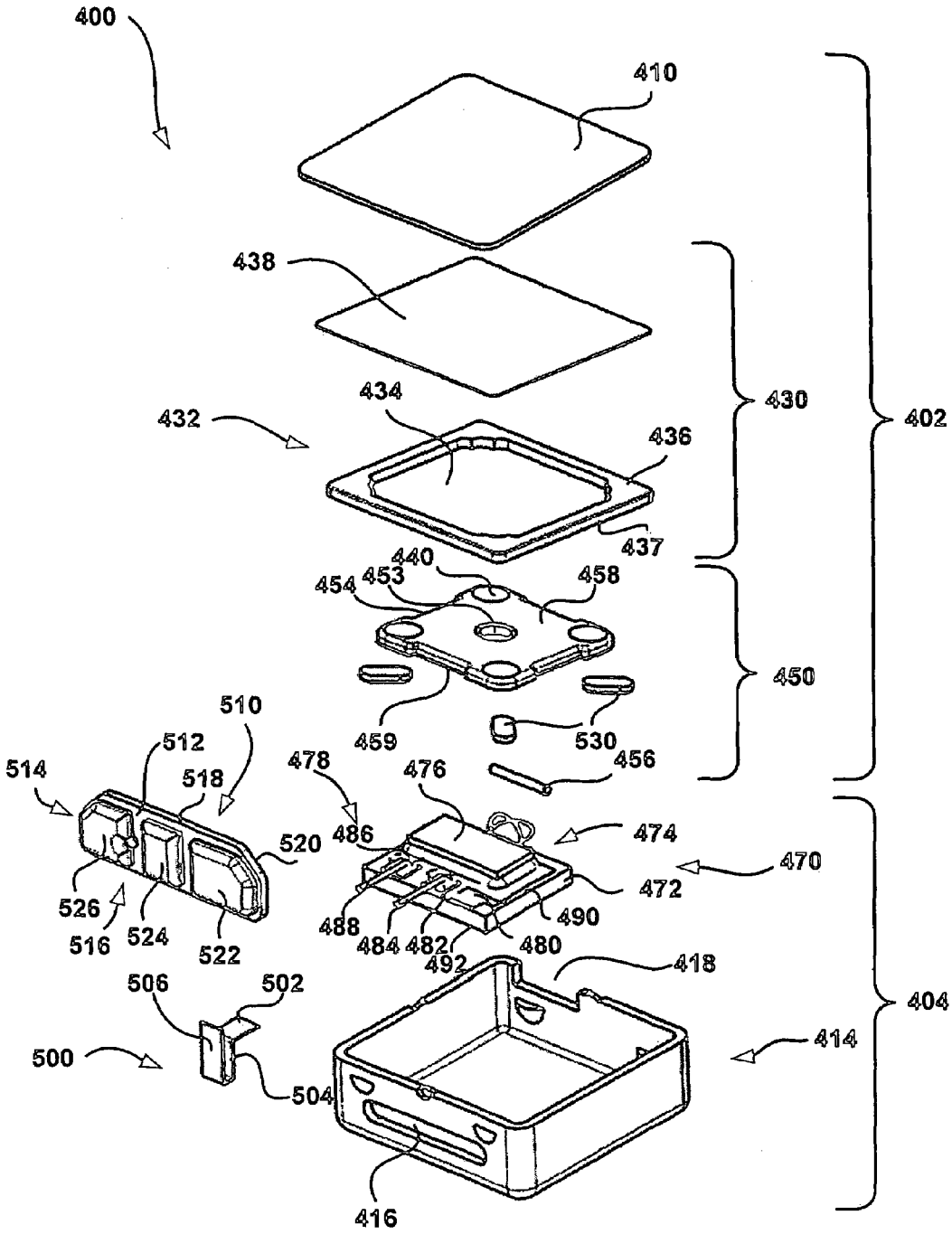
FIG. 8 is an exploded view illustrating a fourth embodiment of a microphone assembly of the present invention.

FIG. 8 illustrates a fourth embodiment of a microphone assembly 400 that can be used in virtually any type of hearing aids, such as BTE, ITE, ITC, CIC, or the like. The embodiment 400 is similar to the embodiment illustrated in FIGS. 1-4, and like elements are referred to using like reference numerals wherein, for example, 110 and 114 correspond to 210 and 214, respectively. The microphone assembly 400 includes a cover 410, a roughly square shape bottom housing 414, an electret microphone portion 402 and a back volume portion 404. The microphone portion 402 comprises a diaphragm assembly 430 and a backplate assembly 450. The cover 410 in the form of a square shape is made of stainless steel. The diaphragm assembly 430 includes a diaphragm support 432 and a diaphragm 438 fixedly attached hereto. The shape of the diaphragm support 432 generally corresponds to the housing 414, but may take the form of the various shapes and sizes in different embodiments, may typically be manufactured of any electrically conductive material such as stainless steel; however, any suitable material that includes an electrically conductive coating may also be utilized. The diaphragm support 432 includes a through hole 434, a first surface 436, and a second surface 437. The diaphragm 438 in the form of a square shape is an electrically conductive material or a thin polymer film, commonly under the trade name MYLAR and under other trade names, peripherally attached to the first surface 436 of the diaphragm support 432, for example, by bonding with adhesive. However, it will be understood by those of ordinary skills in the art that any form of joining would suffice, including compression, or mechanical attachment at the edges, and the like.

The backplate assembly 450 may include an integral connecting wire 456 that electrically couples the microphone portion 402 to the back volume portion 404. The backplate assembly 450 further includes a backplate 454 having a barometric relief 453, a first surface 458, and a second surface 459. A plurality of bumps 440 will be referred to as a spacer for separating the diaphragm assembly 430 from the backplate assembly 450 is formed on the backplate 454. The backplate 454 and the spacer 440 are made of an electrically conducting material such as stainless steel. The first surface 458 of the backplate 454 is plated with a polarized dielectric film or electret material, commonly available under the trade name TEFLON, capable of maintaining an electrostatic charge.

The back volume portion 404 includes a preamplifier assembly 470, a ribbon wire 500, and a flex circuit assembly 510. The preamplifier assembly 470 may comprise a hybrid circuit 472 including an impedance buffer circuit 474 such as, for example, a source-follower field effect transistor (FET) integrated circuit 476 adapted to reduce the RFI, for example RFI generated by communication devices. The preamplifier assembly 470 may further include a plurality of electrical connection terminal 478 having a ground connection (GND) 480, an output connection ($V_{OUT}$) 482, a first wire 484 coupled to $V_{OUT}$ 482, an input connection ($V_{IN}$) 486, and a second wire 488 coupled to $V_{IN}$. The hybrid circuit 472, attached to the microphone portion 402 opposed and adjacent the backplate assembly 450, is positioned within the bottom housing 414 and includes a first surface 490 and a second surface 492. First and second resistance-capacitance networks (not shown) are connected to the terminal 478 of the preamplifier assembly 470. The terminal 478, the FET 476, the first resistance-capacitance network, and the second resistance-capacitance network are operably mounted to the first surface 490 of the hybrid circuit 472. A filter capacitor 494 (see FIG. 10) is operably mounted to the second surface 492 of the hybrid circuit 472. A conductive element 460 (see FIG. 10), such as a silver filled epoxy, attaches to one end of the integral connecting wire 456 thereby connecting the microphone portion 402 to the preamplifier assembly 470 for providing acoustic signals thereto.

The bottom housing 414 is made of stainless steel may include an acoustic port 418 positioned distal to the top edge of the housing 414 and an opening 416 positioned distal to the mid edge of the housing 414 opposed to the acoustic port 418. In operation, acoustic waves enter the microphone assembly 400 via the acoustic port 418 to have the acoustic waves transmitted to the diaphragm assembly 430 and the opening 416 for receiving the ribbon wire 500, the first wire 484, and the second wire 488 are provided to form a connection between the preamplifier assembly 470 and the flex circuit assembly 510. The ribbon wire 500 includes a first region 502, a second region 504, and a third region 506. The ribbon wire 500 may be formed from a blank and may be a gold plated nickel wire having low inductance and low radio frequency (RF) resistance. The ribbon wire 500 can be fabricated and formed using conventional wire fabrication and forming techniques that are well known in the art. As shown in FIG. 8, the first, second, and third regions 502, 504, 506, respectively, are bent such that the third and second regions 506, 504 are substantially parallel to each other and the first region 502 is substantially perpendicular to the second and third regions 504, 506.

The flex circuit assembly 510 includes a flex circuit 512, a plurality of connecting terminals 514 operably connected to the flex circuit 512, and a plurality of soldering pads 516 mounted on the connecting terminals 514. The flex circuit 512 comprises a first surface 518 and a second surface 520 shaped to compliment the side wall of the housing 414. The flex circuit 512 may be made of glass filled epoxy and mounted on the side wall opposed and adjacent the opening 416 by fixedly attaching the second surface 520 of the flex circuit 512 thereto. The plurality of connecting terminals 514 comprises a ground terminal 522, an output terminal 524, and an input terminal 526. The plurality of soldering pads 516 are electrically connected to the terminals 514 to provide electrical connection to the components within the hearing aid (not shown).

Figure 9:
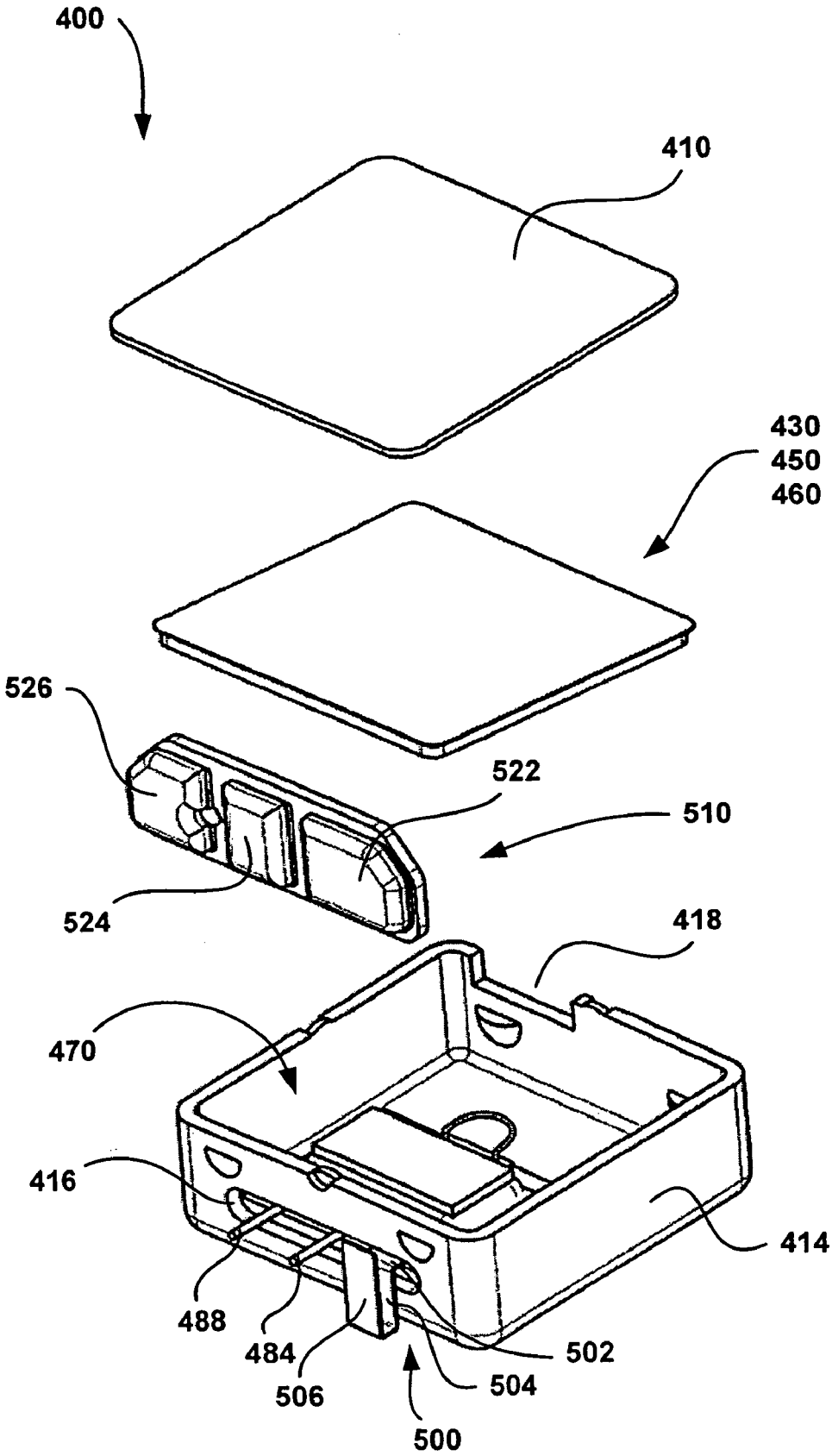
FIG. 9 is an enlarged exploded view of the microphone assembly shown in FIG. 8.
Figure 10:
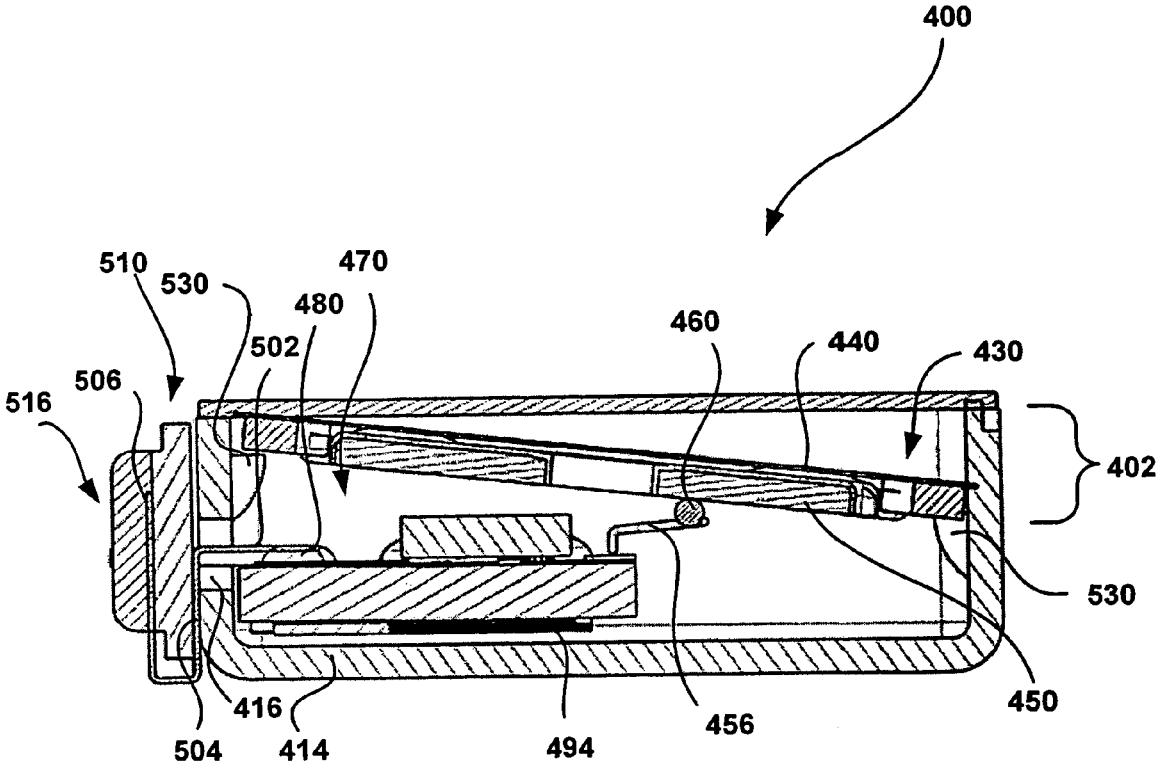
FIG. 10 is a cross-sectional view of the microphone assembly of FIG. 8.

FIG. 9 illustrates an enlarged partially exploded view of the microphone assembly 400 of FIG. 8. In mounted condition, the preamplifier assembly 470 is disposed within the housing 414. The GND 480 of the preamplifier assembly 470 connects to the ground terminal 522 of the flex circuit assembly 510 via the ribbon wire 500 to reduce the sensitivity to low and high RFI signals generated by communication devices. As illustrated in FIGS. 9 and 10, the first region 502 of the ribbon wire 500 is electrically connected to GND 480 and extends through the opening 416. The second region 504 is attached to the housing 414 (e.g., using a conductive adhesive, solder, welding, etc.) to reduce the inductive reactance, and the third region 506 is electrically connected to the flex circuit assembly 510 (see FIG. 10). A connection formed in this manner by positioning the first and second regions 502, 504 between the housing 414 and the GND 480 provides an electrical path to ground and helps reduce undesirable RFI generated by any communication devices. The $V_{OUT}$ 482 of the preamplifier assembly 470 supplies an amplifier output signal is connected with the output terminal 524 of the flex circuit assembly 510 via the first wire 484. The $V_{IN}$ 486 of the preamplifier assembly 470 supplies electric power to the buffer circuit 474 is connected with the input terminal 426 via the second wire 488. The backplate assembly 450, the spacer 440, and the diaphragm assembly 430 collectively constitute the electret microphone portion 402.

FIG. 10 illustrates a cross-sectional view of the exemplary microphone assembly 400. The preamplifier assembly 470 is mounted near the bottom of the housing 414 and the backplate assembly 450 and the diaphragm assembly 430 collectively constitute an electret microphone portion 402 to generate an electrical capacitance corresponding to the spacer 440 having a thickness spaced between the diaphragm assembly 430 and the backplate assembly 450 is mounted on the preamplifier assembly 470 via the integral connecting wire 456 and the conductive element 460 within the housing 414. In mounted condition, a conductive bonding material 530 is applied to the bottom surface of the microphone portion 402 and the inner side wall surfaces of the housing 414 to suppress any RFI signals. The first region 502 of the ribbon wire 500 is electrically connected to GND 480 of the preamplifier assembly 470. A portion of the ribbon wire 500 and the first and second wires 484, 486 extend through the opening 416 of the housing 414 to provide connections between the preamplifier assembly 470 and the flex circuit assembly 510. As shown in FIG. 10, the second region 504 of the ribbon wire 500 is bent such that the second region 504 is parallel to the side wall of the housing 414 and is soldered or welded to the housing 414 to reduce the inductive reactance. The third region 506 of the ribbon wire 500 is also bent in such a way that the third region 506 is parallel to the second region 504 and is electrically connected to the ground terminal 522 of the flex circuit assembly 510. Formed in this manner, the connection by the first and second regions 502, 504, respectively, between the housing 114 and the GND 480 of the preamplifier assembly 470 provides an electrical path to ground and effectively short-circuit undesirable RFI generated by any communication devices. When all the working components are placed in final or closed position within the housing 414, the top housing 410 is then mounted to the bottom housing 414 locking the working components in position. The flex circuit assembly 510 is mounted to the side wall of the housing 414 and a plurality of soldering pads 516 is mounted to the flex circuit assembly 510 for providing an electrical connection to the components within the hearing aid (not shown).

Figure 11:
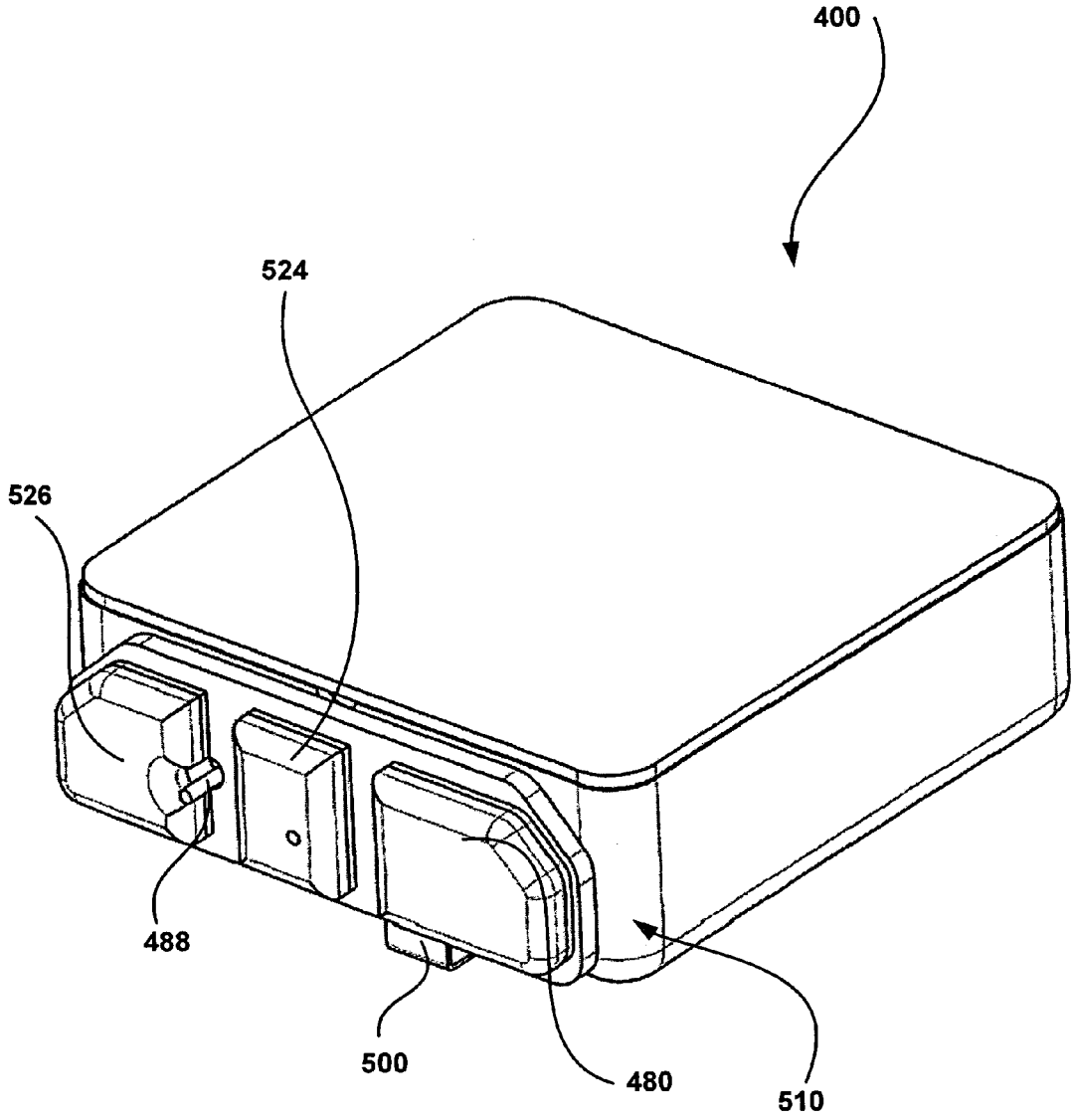
FIG. 11 is a perspective view of the microphone assembly of FIG. 8.

FIG. 11 illustrates a perspective view of a microphone assembly 400 embodying the teachings of the present invention. The flex circuit assembly 510 is fixedly attached to the housing 414 for receiving the ribbon wire 500, which provides an electrical path to the ground and thereby effectively short-circuits RFI generated by any communication devices.

Figure 12:
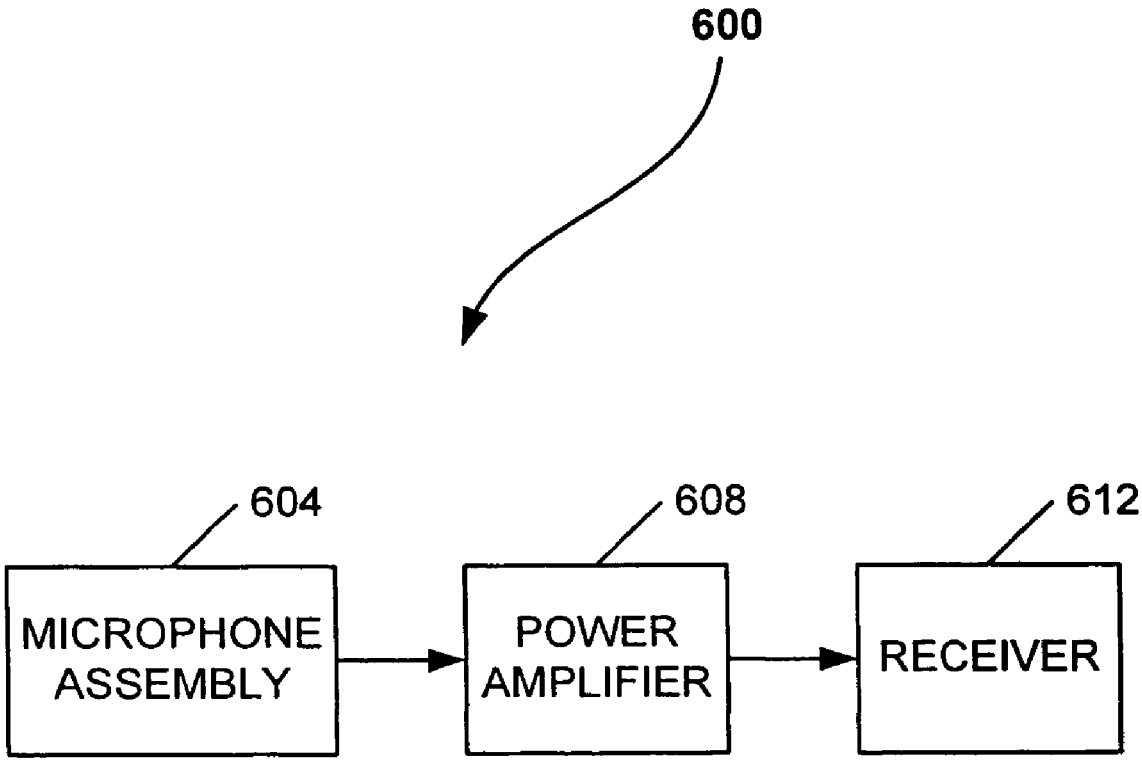
FIG. 12 is a block diagram of an embodiment of a hearing aid.

FIG. 12 is a block diagram of an example hearing aid that may include embodiments of a microphone assembly described above. The hearing aid 600 may include a microphone assembly 604, a power amplifier 608, and a receiver assembly 612 (e.g., a speaker). The microphone assembly 604 may comprise a microphone assembly such as any of the microphone assemblies described above. A microphone in the microphone assembly 604 receives vibration energy, i.e. acoustic sound waves, and generates an electronic signal representative of these sound waves. A preamplifier in the microphone assembly 604 is coupled to the microphone to receive the electronic signal, modify the electronic signal, and communicate the modified electronic signal (e.g. the processed signal) to the power amplifier 608. The receiver assembly 612 driven by the power amplifier 608 converts the modified electronic signal into vibration energy for transmission to a listener.

All references, including publications, patent applications, and patents, cited herein are hereby incorporated by reference to the same extend as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A microphone assembly, comprising:

a housing comprising a conductive material;

a preamplifier circuit disposed within the housing, the preamplifier circuit having a signal input and a ground terminal;

a microphone portion disposed within the housing, the microphone portion having an output coupled to the signal input of the preamplifier circuit;

a ribbon wire attached to the ground terminal of the preamplifier circuit and attached to the housing;

wherein the housing includes a hole;

a flex circuit assembly mounted on an outside surface of the housing, the flex circuit assembly having an output terminal; and a first other wire extending through the hole, the first other wire attached to the output terminal of the flex circuit and attached to an output terminal of the preamplifier circuit.

2. A microphone assembly as defined in claim 1, wherein the ribbon wire extends through the hole of the housing and is attached to a ground terminal of the flex circuit.

3. A microphone assembly as defined in claim 2, wherein the flex circuit is mounted to cover at least a portion of the hole.

4. A microphone assembly as defined in claim 3, wherein the ribbon wire further extends between the flex circuit and the outside surface of the housing.

5. A microphone assembly as defined in claim 4, wherein a bottom surface of the flex circuit is attached to the housing;

wherein the ground terminal of the flex circuit is on a top surface of the flex circuit; and wherein the ribbon wire further extends around the flex circuit.

6. A microphone assembly as defined in claim 2, wherein the preamplifier circuit is attached to the housing a conductive bonding material at a portion of the preamplifier circuit separate from the ground terminal of the preamplifier circuit.

7. A microphone assembly as defined in claim 1, further comprising a second other wire extending through the hole in the housing, the second other wire attached to an input terminal of the flex circuit assembly and attached to an input terminal of the preamplifier circuit.

8. A microphone assembly, comprising:

a housing comprising a conductive material;

a preamplifier circuit disposed within the housing, the preamplifier circuit having a signal input and a ground terminal, the ground terminal of the preamplifier circuit directly coupled to the housing via a first conductive bonding material;

a microphone portion disposed within the housing, the microphone portion having an output coupled to the signal input of the preamplifier circuit;

a flex circuit assembly mounted on an outside surface of the housing, the flex circuit assembly having an output terminal; and a first wire extending through the hole, the first wire attached to the output terminal of the flex circuit and attached to an output terminal of the preamplifier circuit.

9. A microphone assembly as defined in claim 8, wherein the housing includes a tab formed by a partial cutout corresponding to at least part of the hole of the housing;

wherein the ground terminal of the preamplifier circuit is attached to the tab using the first conductive bonding material.

10. A microphone assembly as defined in claim 9, wherein the tab is plated with at least one of gold, silver, or copper.

11. A microphone assembly as defined in claim 8, wherein the first conductive bonding material comprises at least one of a conductive adhesive or a solder material.

12. A microphone assembly, comprising: a housing comprising a conductive material; a preamplifier circuit disposed within the housing, the preamplifier circuit having a signal input and a ground terminal, the ground terminal of the preamplifier circuit directly coupled to the housing via a first conductive bonding material; a microphone portion disposed within the housing, the microphone portion having an output coupled to the signal input of the preamplifier circuit; wherein the preamplifier circuit is attached to the housing a second conductive bonding material at a portion of the preamplifier circuit separate from the ground terminal of the preamplifier circuit; wherein the housing includes a hole; a flex circuit assembly mounted on an outside surface of the housing, the flex circuit assembly having an output terminal; and a first wire extending through the hole, the first wire attached to the output terminal of the flex circuit and attached to an output terminal of the preamplifier circuit.

13. A microphone assembly as defined in claim 12, wherein the first conductive bonding material is the same as the second conductive bonding material.

14. A microphone assembly as defined in claim 12, wherein the first conductive bonding material is different than the second conductive bonding material.

* * * * *

UNITED STATES PATENT AND TRADEMARK OFFICE

CERTIFICATE OF CORRECTION

PATENT NO. : 7,706,559 B2
APPLICATION NO. : 11/176455
DATED : April 27, 2010
INVENTOR(S) : James S. Collins It is certified that error appears in the above-identified patent and that said Letters Patent is hereby corrected as shown below:

IN THE CLAIMS:

Claim 6, Column 11, Line 38, delete “housing a” and insert --housing using a--, therefor.

Claim 8, Column 12, Line 6, after “circuit;” insert --wherein the housing includes a hole;--.

Claim 12, Column 12, Line 33, delete “housing a” and insert --housing using a--, therefor.

Signed and Sealed this
Eighth Day of November, 2011

David J. Kappos

David J. Kappos
*Director of the United States Patent and Trademark Office*